United States Patent [19]

Camilleri

[11] 4,340,221

[45] Jul. 20, 1982

[54] PIN GUIDE ARM

[76] Inventor: Thomas M. Camilleri, 277 Avenue W, Brooklyn, N.Y. 11223

[21] Appl. No.: 156,738

[22] Filed: Jun. 5, 1980

Related U.S. Application Data

[63] Continuation-in-part of Ser. No. 877,119, Feb. 13, 1978, abandoned.

[51] Int. Cl.[3] ..... A63D 5/02

[52] U.S. Cl. ..... 273/43 E

[58] Field of Search ..... 273/43 R, 43 A, 43 E

[56] References Cited

U.S. PATENT DOCUMENTS 3,017,184 1/1962 Gruss ..... 273/43 E 3,179,410 4/1965 Elliott ..... 273/43 E

*Primary Examiner*—Anton O. Oechsle

*Attorney, Agent, or Firm*—D. J. Perrella

[57] ABSTRACT

A pin guide arm for an automatic pinsetter bowling machine is provided with locking guide means and flexible mounting means to lead bowling pins from the pin wheel to the turnaround pan.

7 Claims, 4 Drawing Figures

Fig.1.
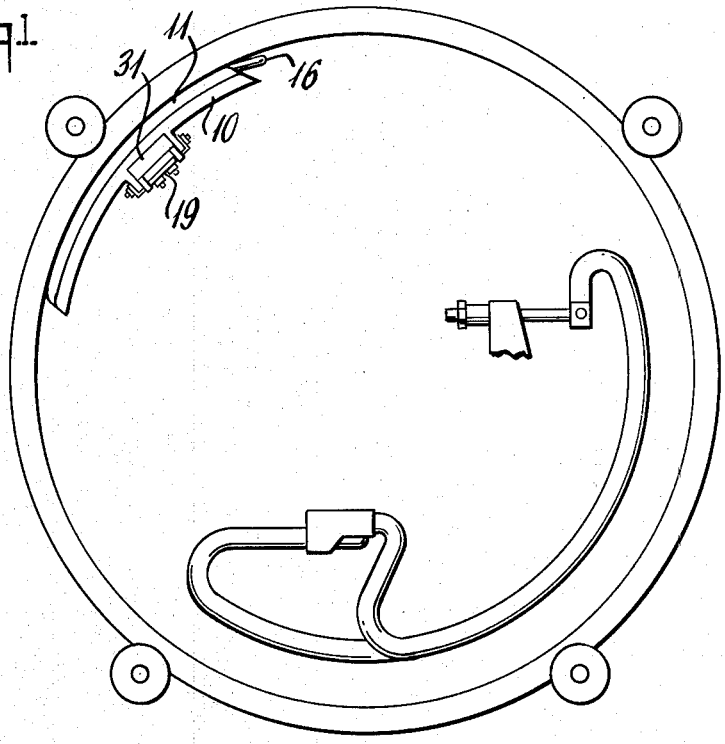
Fig.2.
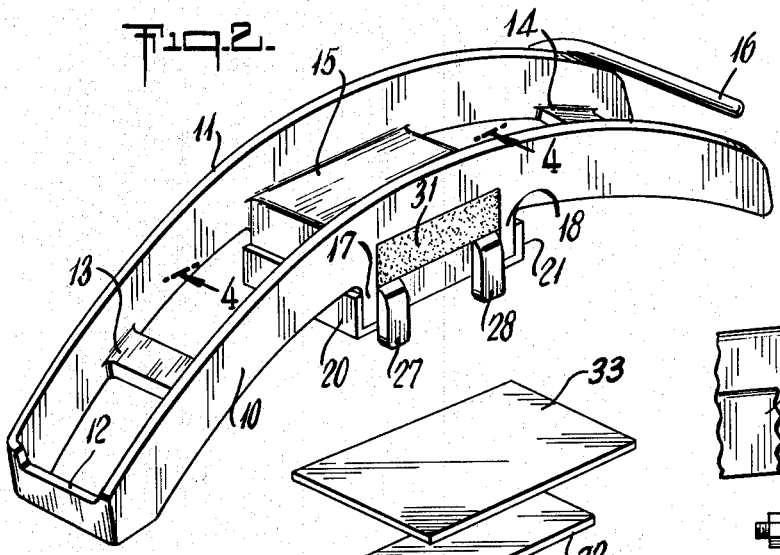
Fig.4.
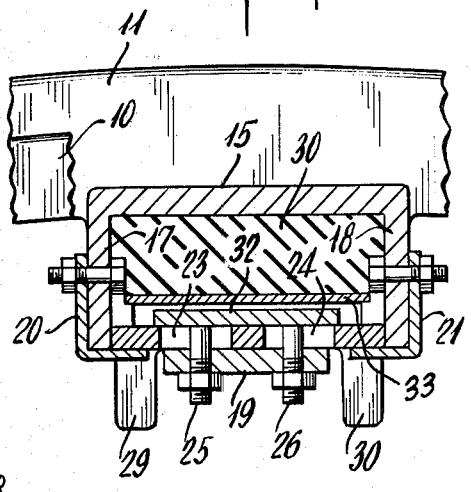
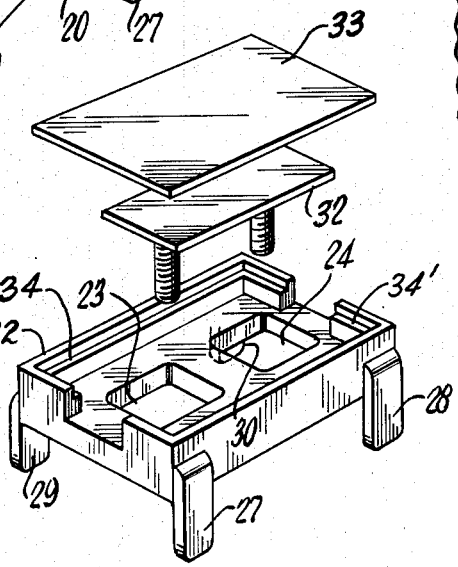
Fig.3.

PIN GUIDE ARM

RELATED APPLICATION

This application is a continuation-in-part of my copending application Ser. No. 877,119 filed Feb. 13, 1978, and now abandoned.

BACKGROUND OF THE INVENTION

In one type of automatic pinsetter bowling machine the pin wheel lifts the bowling pins to a turnaround pan. As a pin is being lifted and passes the horizontal it contacts a pin guide arm which supports the pin and keeps it from falling out of the pin wheel until it is deposited in the turnaround pan near the top of the pin wheel. When excessive wobbling occurs (due to wearing of the pin wheel rollers), the pins do not seat properly against the pin guide arm and a pin can jam in the turnaround pan causing the following pins the fall out of the machine. When this happens the jammed pin must be removed manually and the fallen pins reinstalled manually.

OBJECTS OF THE INVENTION

It is an object of the present invention to provide an improved pin guide arm. Another object is to provide a pin guide arm which prevents turnaround pan pin jams. A further object is to provide a pin guide arm which is capable of adjusting to fluctuations in movement of the pin wheel. Still another object is to provide a pin guide arm having a flexible mounting system. These and other objects of the present invention will be apparent from the following description.

SUMMARY OF THE INVENTION

A pin guide arm of an automatic pinsetter bowling machine is provided with locking guide means and flexible mounting means to lead bowling pins from the pin wheel to the turnaround pan.

BRIEF DESCRIPTION OF THE DRAWINGS

FIG. 1 is a side elevation of a pin wheel containing the pin guide arm of the present invention;

FIG. 2 is a perspective view of the pin guide arm;

FIG. 3 is an exploded view of the mounting bracket; and

FIG. 4 is a section view along the line 4—4 of FIG. 2.

DETAILED DESCRIPTION

In general the pin guide of the present invention comprises two bearing surfaces of unequal height and a mounting bracket adapted to permit the arm to pitch, roll and yaw, each of these movements occurring only about a single axis. The bracket comprises a box-like member having a top, bottom and sides. The bottom has at least one and preferably two slots. A plate adapted to be disposed within the box-like member has fastening means which project through each slot and attach the bracket to a support. The space between the top and the plate is substantially filled with a cushioning material.

Referring now to the drawings the pin guide arm of the present invention comprises a first rail 10 joined to a second higher rail 11 by ribs 12, 13 and 14 and by plate 15. The rails, ribs and plate may be formed, for example, of a single piece of metal as by casting, or by joining several pieces as by welding. A guide bar 16 extends from the upper end of rail 11.

Each end of plate 15 has a depending projection 17 and 18. L-shaped brackets 20 and 21 are attached to the free ends of projections 17 and 18, respectively. Brackets 20 and 21 support a plate 22 having twin slots 23 and 24 which receive plate member 32 having projecting bolts 25 and 26, respectively. The bolts are fastened by nuts to a conventional machine support arm 19. The space between plates 15 and 22 is filled with cushioning material 31 which is supported by plate 33. Plate 33 is in turn supported by shoulders 34 and 34' in plate 22 as clearly illustrated in FIGS. 3 and 4. Depending projections 27, 28, 29 and 30 of plate 22 overlie the bottom arm of L-shaped members 20 and 21 to restrict movement of plate 22.

As a result of the construction of the mounting bracket the pin guide arm has 3 degrees of movement: it can pitch (oscillation of longitudinal axis in the vertical plane), it can roll (rock from side to side), and it can yaw (oscillation of the longitudinal axis in the horizontal plane). Each of these movements occurs, respectively, only about a single axis. Guide bar 16 is mounted at the end of the pin guide arm closest to the turnaround pan and not only supports the pin as it leaves the pin guide arm but guides it into the turnaround pan.

The pin guide arm of the present invention is adapted to cooperate with the pin wheel to support a bowling pin during a part of the distance that the pin is raised by the pin wheel to the turnaround pan. The pin guide arm of the present invention comprises two rails each of which provides a bearing surface for the bowling pin. One of the rails is higher than the other rail.

The use of two rails of unequal height plus the flexible mounting permits the pin guide to be positioned so as to engage the pin firmly and retain it in its pocket. The present invention thus provides a flexibly mounted pin guide arm which can fluctuate with eccentricities in the rotation of the pin wheel. In addition the unequal heights of the two rails 10 and 11 prevent any motion of the bowling pin while it is supported on the pin guide arm.

What is claimed is:

1. A pin guide arm for an automatic pin-setter bowling machine, the pin guide arm adapted to cooperate with the pin wheel to support a bowling pin during a part of the distance the pin is raised by the pin wheel to a turnaround pan, the pin guide arm comprising two rails, each rail providing a bearing surface for the bowling pin, the bearing surface of one rail being higher than the bearing surface of the other rail and the higher rail being provided with guide means at about the end of the pin guide arm closest to the turnaround pan, the pin guide arm being attached to a support by a mounting bracket permitting the pin guide arm to pitch, roll and yaw.

2. A pin guide arm according to claim 1 wherein the mounting bracket comprises box-like member having a top member, a bottom member and side members, the bottom member having at least one slot, a plate disposed within the interior of the box-like member, the plate having fastening means projecting through the slot, the space between the top member and the plate containing a cushioning material.

3. A pin guide arm according to claim 2 wherein the bottom member has two slots.

4. A pin guide arm according to claim 3 wherein the plate has fastening means projecting through each slot.

5. A pin guide arm for an automatic pinsetter bowling machine, the pin guide arm adapted to cooperate with the pin wheel to support a bowling pin during a part of the distance the pin is raised by the pin wheel to a turn-around pan, the pin guide arm comprising two rails, each rail providing a bearing surface for the bowling pin, the bearing surface of one rail being higher than the bearing surface of the other rail, the pin guide arm being attached to a support by a mounting bracket permitting the pin guide arm to pitch, roll and yaw, the mounting bracket comprising a box-like member having a top member, a bottom member and side members, the bottom member having at least one slot, a plate disposed within the interior of the box-like member, the plate having fastening means projecting through the slot, the space between the top member and the plate containing a cushioning material.

6. A pin guide arm according to claim 5 wherein the bottom member has two slots.

7. A pin guide arm according to claim 6 wherein the plate has fastening means projecting through each slot.

* * * * *